US012600515B2

(12) United States Patent
Federer et al.

(10) Patent No.: US 12,600,515 B2
(45) Date of Patent: Apr. 14, 2026

(54) METHOD FOR MONITORING THE SEALING OF A CONTAINER AND DEVICE WITH IMPROVED SEALING MONITORING

(71) Applicant: Roche Molecular Systems, Inc., Pleasanton, CA (US)

(72) Inventors: Paul Federer, Lucerne (CH); Pius Hermann, Lucerne (CH); Stefan Vollenweider, Aargau (CH)

(73) Assignee: Roche Molecular Systems, Inc., Pleasanton, CA (US)

( * ) Notice: Subject to any disclaimer, the term of this patent is extended or adjusted under 35 U.S.C. 154(b) by 299 days.

(21) Appl. No.: 18/511,844

(22) Filed: Nov. 16, 2023

(65) Prior Publication Data

US 2024/0158118 A1 May 16, 2024

(30) Foreign Application Priority Data

Nov. 16, 2022 (EP) ..... 22207916

(51) Int. Cl.
*B65B 51/10* (2006.01)
*B65B 57/00* (2006.01)

(52) U.S. Cl.
CPC ..... *B65B 51/10* (2013.01); *B65B 57/00* (2013.01); *B65B 2051/105* (2013.01)

(58) Field of Classification Search
CPC ..... B29C 65/18; B29C 65/30; B29C 66/112; B29C 66/131; B29C 66/53461; B29C 66/723; B29C 66/73921; B29C 66/742; B29C 66/7465; B29C 66/8322; B29C 66/849; B29C 66/91212; B29C 66/91231; B29C 66/91421; B29C 66/91443; B29C 66/91951; B29C 66/9221; B29C 66/961;
(Continued)

(56) References Cited

U.S. PATENT DOCUMENTS

2007/0000901 A1* 1/2007 Mister ..... B29C 66/1122 219/237
2010/0043352 A1* 2/2010 Hashimoto ..... B29C 65/18 53/375.9

FOREIGN PATENT DOCUMENTS

CN 108376662 A * 8/2018 ..... H01L 21/67103
DE 4417345 C2 * 4/1997 ..... B65D 51/20
EP 3925765 A1 12/2021
(Continued)

OTHER PUBLICATIONS

Extended European Search Report for EP Appl. 22207916.2, filed Nov. 16, 2022, received on Apr. 26, 2023.

*Primary Examiner* — Andre J Allen
(74) *Attorney, Agent, or Firm* — Maneesh Gupta

(57) ABSTRACT

A method for monitoring the sealing of a container in a system or device is described. The method includes the following steps: controlling the heating element to heat a heating stamp to a predetermined sealing temperature, monitoring the temperature of the heating stamp, determining a temperature over time curve of the heating stamp by means of at least one temperature sensor, determining at least one characteristic of the temperature over time curve, comparing the determined at least one characteristic of the temperature over time curve with a reference value, and determining a sealing property of the sealing of the container based on said comparison of the determined at least one characteristic of the temperature over time curve with the reference value.

15 Claims, 4 Drawing Sheets

(58) Field of Classification Search
CPC . B29C 66/962; B65B 2051/105; B65B 51/10; B65B 57/00; B65B 7/2878
See application file for complete search history.

(56) References Cited

FOREIGN PATENT DOCUMENTS

| | | | | | |
|---|---|---|---|---|---|
| EP | 4180212 | A1 | * | 5/2023 | ..... B29C 66/91213 |
| JP | 2006264750 | A | * | 10/2006 | |
| JP | 2023071386 | A | * | 5/2023 | ..... B29C 66/1122 |
| WO | WO-9002082 | A1 | * | 3/1990 | ..... B29C 66/1222 |
| WO | 9914030 | A1 | | 3/1999 | |
| WO | WO-2010145713 | A1 | * | 12/2010 | ..... B65B 9/20 |
| WO | 2016055598 | A1 | | 4/2016 | |

* cited by examiner

METHOD FOR MONITORING THE SEALING OF A CONTAINER AND DEVICE WITH IMPROVED SEALING MONITORING

CROSS-REFERENCE TO RELATED APPLICATIONS

The present patent application claims priority to EP Application 22207916.2, filed Nov. 16, 2022, the entire contents of which is incorporated herein by reference for all purposes.

TECHNICAL FIELD

The invention relates to a method for monitoring the sealing of a container, preferably in a laboratory system or device, to a device, preferably a laboratory system or device, with improved sealing monitoring of a container, to a computer program product for controlling a method for monitoring the sealing of a container, preferably in a laboratory system or device and to a computer-readable storage medium for said computer program product.

BACKGROUND

Sealing of containers serves different purposes. In particular in the field of laboratory system or devices, sealing of different type of containers is performed in order to simplify storage of liquids, solids, samples etc., to avoid evaporation of liquids, to avoid contamination of the content of the container or to avoid cross contamination between different containers.

Different solutions are known. The container may be sealed by using caps that are screwed or otherwise hold in place above the opening of the container. Another used method is to seal the container with an adhesive foil. The foil may be provided with an adhesive that seals the opening of the container. In some cases, the foil or the opening of the container may be provided with an adhesive and the sealing is performed through heating of the foil arranged on the opening of the container. This has the advantage that a very resistant sealing can be provided.

As an example, a known device for sealing a container comprises a holder for the container and a heating stamp. The container is arranged between the holder and the heating stamp and a foil is placed on the opening of the container to be sealed. The holder and/or the heating stamp are then moved relative to each other until the heating stamp contacts the foil arranged above the opening of the container. The heating stamp and/or the holder are pressed against each other with a predetermined force, e.g. by biasing the heating stamp and/or the holder with a spring, and the heating stamp is heated, therefore partially melting the foil or an adhesive layer of the foil, which then adheres to a surface surrounding the opening of the container. After a predetermined time, the heating stamp and/or the holder are moved again to the initial position in order for the container to be extracted from the device.

However, in the case where heat is using for melting the foil, the opening of the container and/or the adhesive, enough pressure should be applied on the foil arranged above the opening of the container to guarantee that the sealing is performed correctly. Therefore, systems and methods to control and monitor the force applied to the foil/opening of the container have been put in place.

In some cases, however, it is desirable to avoid pressure stress to the foil and/or the opening of the container. This can have different reasons. The container or the foil may be e.g. very fragile. Another reason is that in some cases, the device used for sealing the container are miniaturized in such a way that including a force monitoring would also increase the dimensions of the device for sealing, which in some cases due to space constraints should be avoided.

It is therefore aim of the present invention to provide a method for monitoring the sealing of a container and a device with an improved sealing monitoring that overcomes the disadvantages of known devices and in particular guarantees that the container is sealed reliably, in particular without the need of applying pressure to the seal and container opening.

SUMMARY

According to the present invention, a method for monitoring the sealing to a container in a system or device, in particular a laboratory system or device, is described.

According to the present invention, a laboratory system or device may be any device used in a laboratory but is preferably an analyzer for performing analysis of samples, more preferably an analyzer for performing nucleic acid testing and/or immunoassays of samples.

Within the meaning of the present invention, a container is meant to be any type of container configured to contain a liquid or a solid, in particular a bottle, a vial, a sample tube, a can, a multi well plate, a box, a reagent cartridge, etc. comprising one or more openings. The material of the container may be, but is not limited to, glass, plastic, metal and combinations thereof. The at least one opening of the container may be configured with a portion surrounding the at least one opening designed as a sealing surface, where a sealing foil can adhere and seal the opening. The sealing surface may be provided with an adhesive.

In addition, a foil as described in the present application may be any suitable material provided as a sheet that can be used for sealing the opening of the container by means of heat application. This can include single layered or multi layered structures and comprise an adhesive.

When sealing is performed, heat is used to at least partially melt the sealing surface and/or the foil and/or a layer of the foil and/or an adhesive to securely bind the foil with the container, therefore sealing the at least one opening of the container.

According to the present invention the system or device comprises an holder for receiving a container to be sealed.

The system or device further comprises an heating stamp with a heating surface and a heating element. The heating element is configured to heat the heating stamp and therefore the heating surface. The heating element may be any suitable heating element, preferably an electrical heating element. In a more preferred embodiment, a peltier element is used, which can be used for both heating and cooling of the heating stamp.

The system or device further comprises at least one temperature sensor for monitoring a temperature of the heating stamp. The at least one temperature sensor is preferably arranged in the heating stamp to reliably monitor the temperature of the heating stamp and therefore of the heating surface. It is clear that with an heating element and a heating sensor, an open or closed loop control system can be established to reliably control the temperature of the heating stamp within a given tolerance range. Preferably, the control system is a PID control system.

The holder and the heating stamp are movably arranged relative to each other between a loading position and a sealing position.

Depending on the setup of the system or device, the holder may be fixed and the heating stamp movably arranged, the holder may be movably arranged and the heating stamp may be fixed, or both the holder and the heating stamp may be movably arranged.

When in the sealing position, the heating stamp, in particular the heating surface of the heating stamp, is arranged closer to the holder than in the loading position. In addition, when in the sealing position, the distance between the heating stamp and the holder is such that the heating surface of the heating stamp is in contact with a foil arranged on an opening of the container, therefore pressing the foil by means of the heating surface on the sealing surface of the container.

Therefore, in the sealing position, when the heating element is heated to a temperature which is sufficient for sealing the opening of the container, as explained above, the temperature of the foil and/or of the sealing surface and/or of any adhesive layers present can be raised such that the materials for sealing are at least partially melted and the opening of the container can be sealed by means of the foil.

Regarding the holder and the heating stamp, it should be noted that the heating stamp, in particular the heating surface, may have a shape that is complementary to the shape of the container to be sealed, such that the container to be sealed is completely enclosed within the holder and the heating stamp when in the sealing position.

The heating surface of the heating stamp may be provided with protrusions, e.g. a protruded pattern, such that, when in the sealing position, only the protrusions are in contact with the foil. As an example, in case of a container with a circular opening and sealing surface, the protrusion may also have a circular or annular shape with dimensions matching the circular sealing surface, therefore providing a circular sealing. In a preferred embodiment, where a multi well plate is provided with a plurality of wells, in particular circular wells, and a sealing surface corresponding to the upper surface of the multi well plate, the sealing surface may have a protruded pattern with a shape matching the sealing surface or portions thereof, in the case of circular wells being a pattern of a plurality of circular or annular protrusions, such that every well of the multi well plate can be sealed relative to the other wells of the multi well plate.

The system or device further comprises a control unit which is connected at least to the heating element and the temperature sensor, as explained above, for providing a control system to the heating element. The control unit may be a control unit dedicated to the sealing arrangement of the system or device and connected also to a general control unit of the system or device or may be implemented into a general control unit of the system or device, e.g. in a computer device, controlling also other components of the system or device, such as the movement of the heating stamp and/or holder, etc.

According to the present invention, sealing of the container is performed as following:

The heating element is activated and controlled by the control unit to heat the heating stamp to a predetermined sealing temperature. Before, during or after heating of the heating stamp to the predetermined sealing temperature, a container and a foil are arranged, either manually or by means of an automated handler, in the holder. In this regard, the holder may be also otherwise movably arranged in the system or device, e.g. slidable, in order to be better accessible when handling the container. Also, the container may already be present in the holder and the foil may be arranged between the container and the heating stamp at a later stage when already in the loading position.

With the help of the at least one temperature sensor, the temperature of the heating stamp is controlled and regulated. In addition, the control unit determines a temperature over time curve of the heating stamp. The temperature over time curve is stored in a storage device of the control unit or connected to the control unit and is preferably updated in real time.

Then the holder and/or the heating stamp are moved from the loading position to the sealing position. Therefore, upon contact of the heating surface with the foil, sealing of the opening of the container is started. Preferably, the heating stamp is pre-heated to the predetermined temperature before contacting the foil.

After a predetermined amount of time, the holder and/or the heating stamp are moved again from the sealing position to the loading position. The predetermined amount of time (which is the contact time of the heating surface with the foil) is chosen such that a correct sealing should be successful (e.g. according to the specifications of the foil and/or container manufacturer).

Then, the control unit determines at least one characteristic of the temperature over time curve (TT) that has been determined and compares the determined at least one characteristic of the temperature over time curve (TT) with a reference value.

The control unit then determines a sealing property of the sealing of the container based on said comparison of the determined at least one characteristic of the temperature over time curve (TT) with the reference value.

Within the meaning of the present invention, a sealing property is meant as being the quality of the sealing of the container, preferably if the sealing is considered successful or unsuccessful. In the case where the sealing property is determined as being unsuccessful, the control unit may be configured to control the system or device to repeat the steps cited above one or several times until the sealing has been determined as successful. Alternatively or additionally, the control unit may be configured to abort the process, flag the results as unsuccessful and inform an operator of the unsuccessful sealing of the container.

Alternatively, instead of moving the holder and/or the heating stamp from the sealing position to the loading position after a predetermined amount of time, the control unit can already determine the at least one characteristic of the temperature over time curve (TT) during the sealing process. This has the advantage that the sealing process can be stopped in the case the control unit determines that the sealing is not successful.

Preferably, the characteristic of the temperature over time curve (TT) is the course of the temperature over time curve (TT) and the reference value is a reference temperature over time curve (rTT). The course of the temperature over time curve (TT) can be easily compared to a reference temperature over time curve (rTT). The control unit then determines if the course of the temperature over time curve (TT) lies within a given tolerance range of the reference temperature over time curve (rTT). If this is the case, the sealing property is determined as being properly sealed.

Additionally or alternatively, the characteristic of the temperature over time curve (TT) is an integral of the temperature over time curve (TT) and the reference value is a reference integral value. By computing the integral of the temperature over time curve (TT), thus the surface below the curve, slight variations of the curve course can be taken into consideration.

It should be self explaining that both methods related to the determination of the characteristic of the temperature over time curve (TT) can be implemented using well known methods and algorithms.

Preferably, the system or device comprises an actuator for moving the holder and/or the heating stamp between the loading position and the sealing position and the control unit is connected to the actuator and controls the actuator for moving the holder and/or the heating stamp. This example provides integration of the control unit not only for controlling and monitoring the temperature of the heating stamp, but also for controlling operation of the holder and/or heating stamp, therefore increasing automation and reducing human interaction.

Preferably. the at least one characteristic of the temperature over time curve (TT) is determined for a time interval, the time interval corresponding to the time where the holder and the heating stamp are in the sealing position. It should be clear from the description above that this method can be easily implemented by determining the temperature over time curve (TT) only during the time interval. For other purposes, the temperature over time curve (TT) may be determined over the whole operational time of the heating element.

The system or device preferably comprises at least one force sensor for measuring a force applied to the holder and/or the heating stamp when in the sealing position and the control unit is connected to the force sensor and determines a force applied to the holder and/or the heating stamp. The force sensor is preferably arranged within the heating stamp or the holder.

Preferably, the control unit is further configured to monitor the force applied to the holder and/or the heating stamp, and to determine if sufficient force has been applied to the holder and/or the heating stamp. Determination of the sufficient force may be performed by comparing the measured force with a predetermined threshold, or by determining a curve of the force over time and comparing the curve of the force over time with a reference curve or by integrating the curve over a given period of time and comparing the integral with a reference integral, with methods known in the art. In this case, the control unit may determine that the sealing property may be considered as unsuccessful even in the case where the at least one characteristic of the temperature over time curve (TT) that has been determined has been determined as being in-line with a reference value. The force sensor may be preferably used for determining that the holder and the sealing stamp are in the sealing position, because force build-up is generated when the sealing stamp contacts the holder, the container or the foil.

Also in the case where more than one temperature sensor are present, the comparison of the at least one characteristic of the temperature over time curve (TT) may be done by comparing the temperature over time curve of every temperature sensor with a single reference value or a reference value specific for a single temperature sensor of the plurality of the temperature sensors.

The invention further relates to a computer program product comprising instructions to cause the laboratory system or device described above to execute the steps of the method according to the present invention as well to a computer-readable storage medium having stored thereon said computer program product. The above description applying accordingly to the computer program product and the computer readable storage medium

DETAILED DESCRIPTION

The invention will be described now by way of a preferred embodiment in connection with the drawings.

As used herein, the terms "have", "comprise" or "include" or any arbitrary grammatical variations thereof are used in a non-exclusive way. Thus, these terms may both refer to a situation in which, besides the feature introduced by these terms, no further features are present in the entity described in this context and to a situation in which one or more further features are present. As an example, the expressions "A has B", "A comprises B" and "A includes B" may both refer to a situation in which, besides B, no other element is present in A (i.e. a situation in which A solely and exclusively consists of B) and to a situation in which, besides B, one or more further elements are present in entity A, such as element C, elements C and D or even further elements.

Further, it shall be noted that the terms "at least one", "one or more" or similar expressions indicating that a feature or element may be present once or more than once typically will be used only once when introducing the respective feature or element. In the following, in most cases, when referring to the respective feature or element, the expressions "at least one" or "one or more" will not be repeated, non-withstanding the fact that the respective feature or element may be present once or more than once.

Further, as used herein, the terms "preferably", "more preferably", "particularly", "more particularly", "specifically", "more specifically" or similar terms are used in conjunction with optional features, without restricting alternative possibilities. Thus, features introduced by these terms are optional features and are not intended to restrict the scope of the claims in any way. The invention may, as the skilled person will recognize, be performed by using alternative features. Similarly, features introduced by "in an embodiment of the invention" or similar expressions are intended to be optional features, without any restriction regarding alternative embodiments of the invention, without any restrictions regarding the scope of the invention and without any restriction regarding the possibility of combining the features introduced in such way with other optional or non-optional features of the invention.

Figure 1:
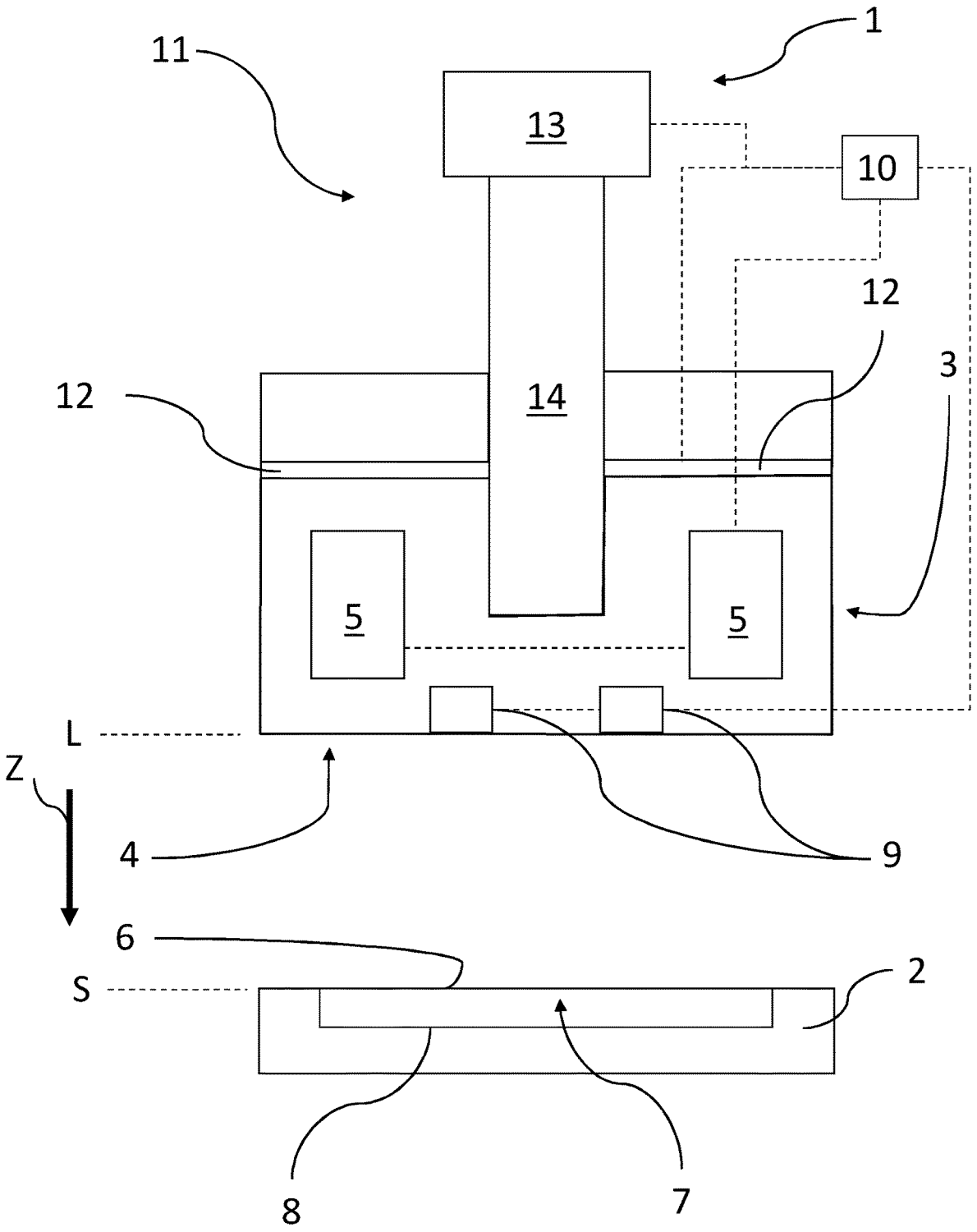
FIG. 1 shows a schematic sectional view of a device according to the present invention.

In FIG. 1, a component of the laboratory system or device 1 according to the present invention is shown. From the bottom, a holder 2 for a container 8 is shown schematically, wherein the opening 7 of the container 8 is suggested by the arrow. Above the opening 7 of the container 8 there is arranged a sealing foil for sealing the opening 7 of the container.

Above the holder 2, a heating stamp 3 is arranged. The heating stamp 3 comprises a heating surface 4, two heating elements 5 and a force sensor 12. The heating stamp 3 and therefore the heating surface 4 is heated by controlling the heating elements 5 via the control unit 10.

The control unit 10 is also connected, symbolized by the dotted line, to an actuator 11 for moving the heating stamp 3 along the Z axis between a loading position L and sealing position S, wherein in the sealing position S the heating surface 4 of the heating stamp 3 contacts the foil 6. Loading position L and sealing position S are shown by means of a dotted line corresponding to a plane of the heating surface 4 in the respective position.

In the example shown in FIG. 1, the actuator 11 comprises a motor 13 and a spindle 14, wherein rotation of the motor 13 and therefore of the spindle 14 causes the movement of the heating stamp 3 along the Z axis. The heating stamp 3 is provided with a threaded portion (not shown) engaging the spindle 14 for this purpose.

For sealing the container 8, the heating stamp 3 is controlled by the control unit 10 and heated to a predetermined temperature. After the predetermined temperature has been reached, the heating stamp 3 is lowered by the actuator 11 from the loading position L to the sealing position S, wherein the heating surface 4 contacts the foil 6, therefore sealing the container opening 7 with the foil, as explained above. The heating stamp 3 is pressed against the holder 2 with a predetermined force, which is monitored and controlled by the control unit by means of the force sensor 12, and may be used in a preferred example for determining that the heating stamp 3 has reached the sealing position S.

During the sealing process, when the heating stamp 3 is in the sealing position, the control unit monitors the temperature of the heating stamp 3 by means of the temperature sensors 9 and determines a temperature over time curve (TT) of the heating stamp. Different TT curves are shown schematically in FIGS. 2A-F. After a predetermined amount of time, the heating stamp 3 is raised again to the loading position L, thus terminating the sealing process.

The control unit then determines, based on a characteristic of the determined TT curve and comparison with a reference value, if the sealing process was successful performed or not.

Alternatively, the control unit determines in real time, based on a characteristic of the determined TT curve and comparison with a reference value, that the sealing process has been performed successfully and therefore controls the actuator 11 to raise the heating stamp 3 to the loading position, therefore terminating the sealing process. In addition, the control unit may be configured to raise the heating stamp 3 after a predetermined amount of time if the real time determination of the termination of the sealing process is not successful.

Figure 2A:
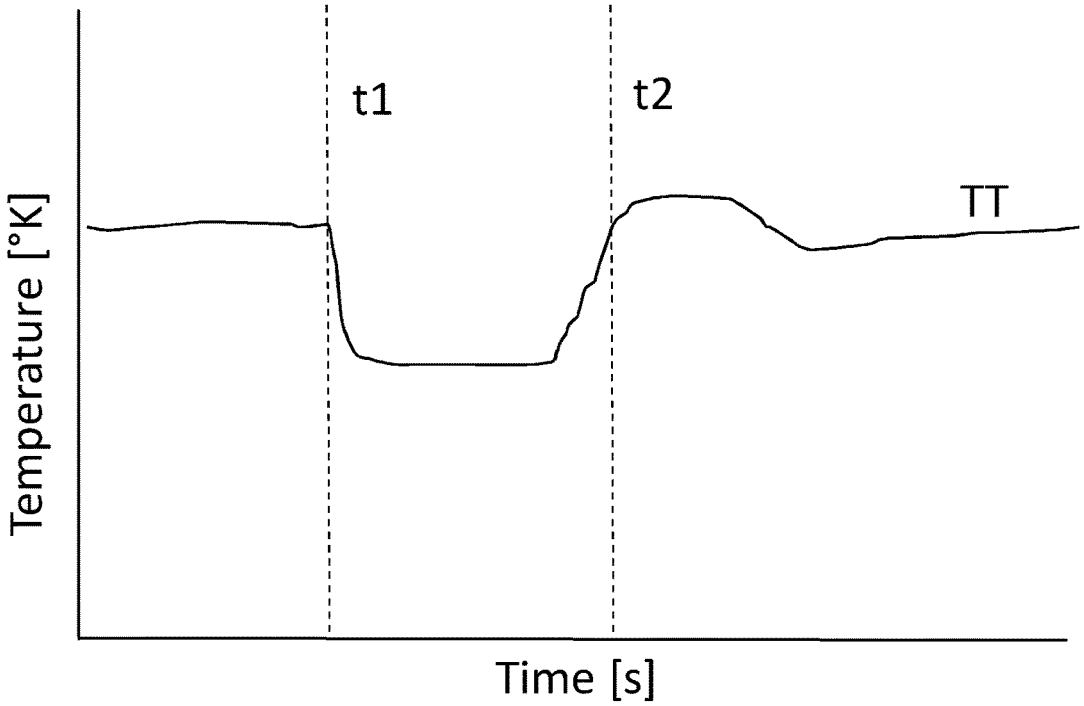
FIGS. 2A-F show examples of temperature over time curves.

FIG. 2A shows a TT curve for a successful sealing process determined via one of the temperature sensors 9. At the time t1, the heating stamp 3 contacts the foil 6, and therefore, the temperature drops. However, the control unit controls the heating stamp 3 to keep the predetermined temperature, and the temperature raises again. At time t2, the heating stamp 3 is moved from the sealing position S to the loading position L, therefore terminating the sealing process. Determination of the success of the sealing process is made by the control unit by comparing the determined TT curve with a reference value. The reference value may be a reference TT curve, wherein the control unit 10 determines if the TT curve lies within a predetermined tolerance range from the reference TT curve. Alternatively or additionally, the integral of the TT curve, the surface below the TT curve, may be compared with a reference integral value of a reference TT curve. Preferably, the determination is only done for the period of time from t1 until t2. For sake of simplicity, the TT curve of FIG. 2A is taken as a reference when comparing the following TT curves shown in FIGS. 2B-D.

Figure 2B:
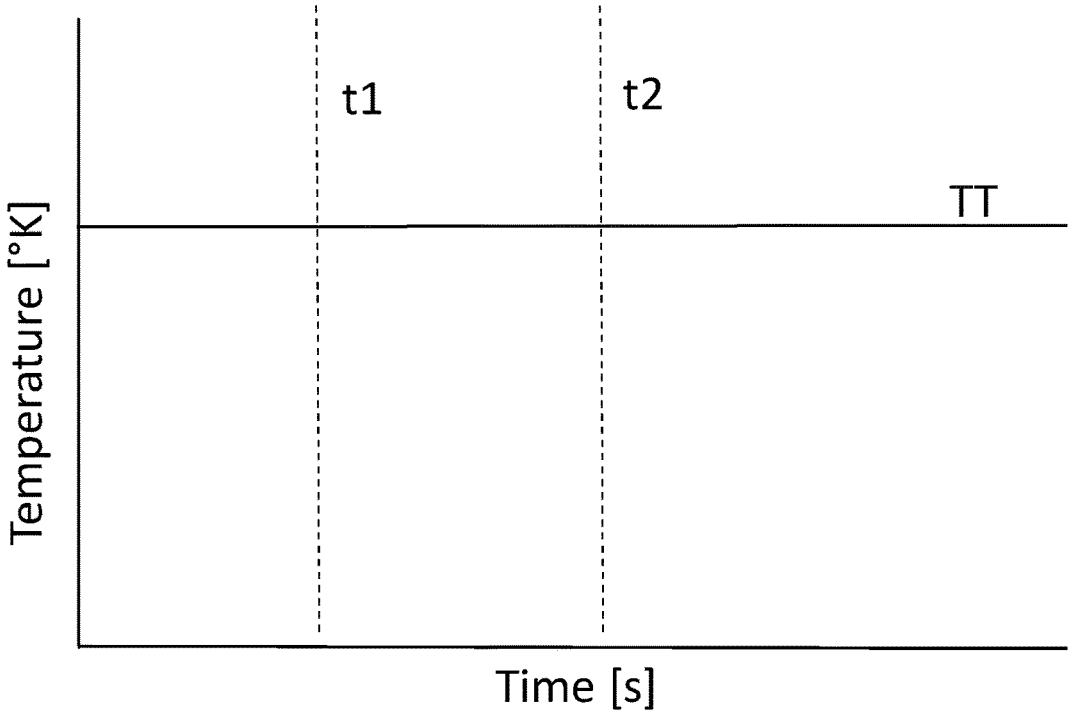

FIG. 2B shows a TT curve for an unsuccessful sealing process determined via one of the temperature sensors 9. As can be seen, the TT curve is a straight horizontal line, meaning that there was no thermal contact between the heating stamp 3 and the foil 6.

Figure 2C:
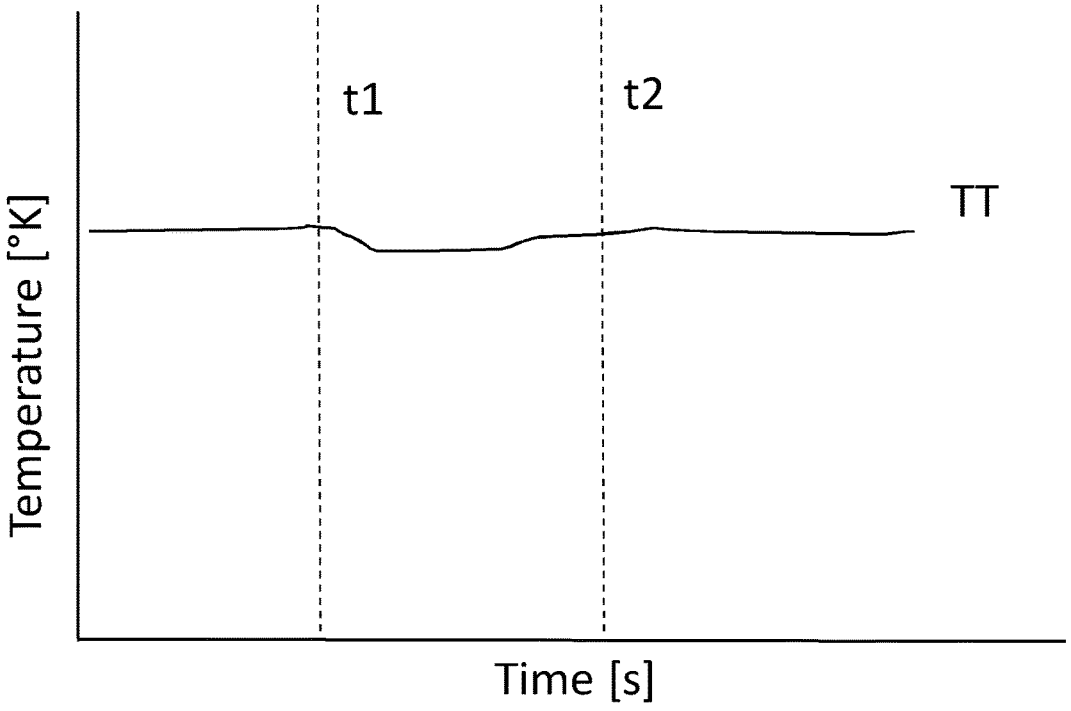

FIG. 2C shows another TT curve for an unsuccessful sealing process determined via one of the temperature sensors 9. As can be seen, the TT curve shows only a minor decrease of temperature between the time t1 and t2, meaning that there was no sufficient heat transfer from the heat stamp 3 to the foil 6 for a sufficient sealing. This determination is done by comparing the TT curve and/or the integral of the TT curve, preferably from t1 to t2, with a reference value, as shown in FIG. 2A.

Figure 2D:
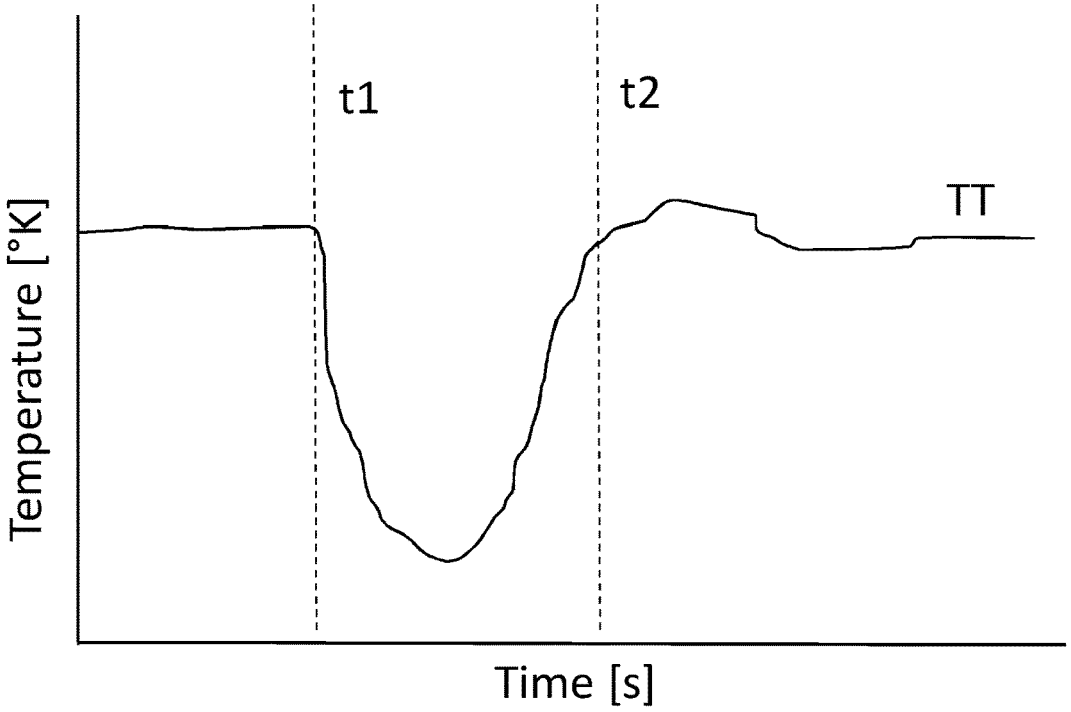

FIG. 2D shows another TT curve for an unsuccessful sealing process determined via one of the temperature sensors 9. As can be seen, the TT curve shows a higher decrease of temperature between the time t1 and t2 as compared to the TT curve shown in FIG. 2A, meaning that there was an anomaly in the heat transfer from the heat stamp 3 to the foil 6, which can mean that here was a thermal short circuit between the heat stamp 3 and the holder 2, e.g. because the foil 6 was missing. This determination is done by comparing the TT curve and/or the integral of the TT curve, preferably from t1 to t2, with a reference value, as shown in FIG. 2A.

Figure 2E:
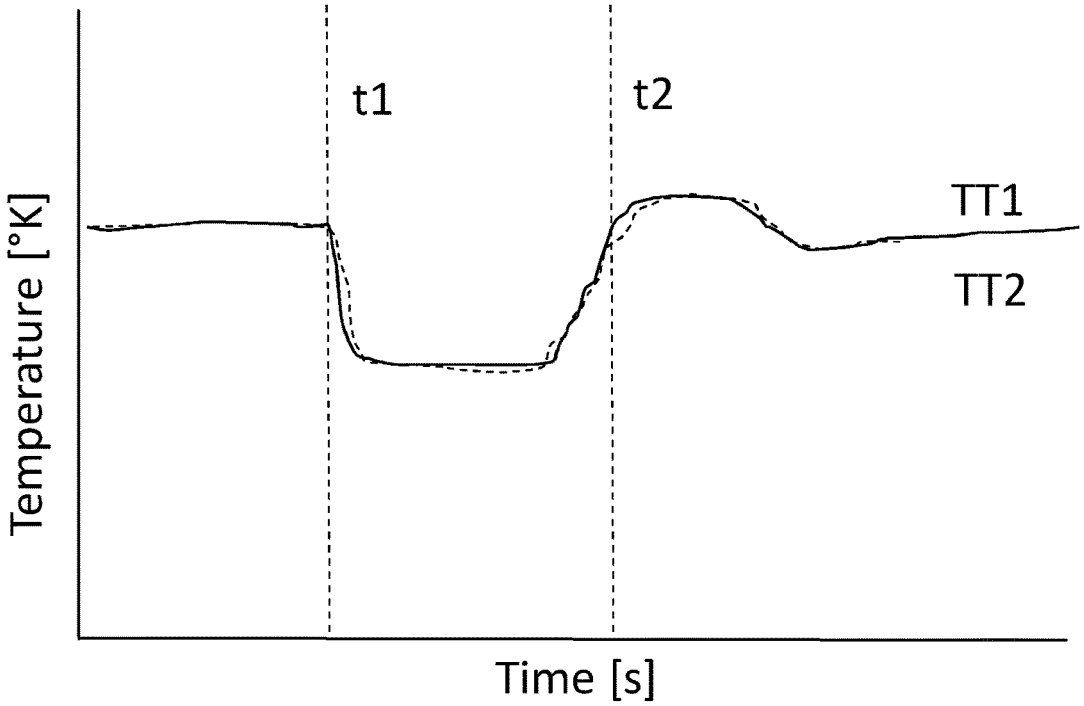
Figure 2F:
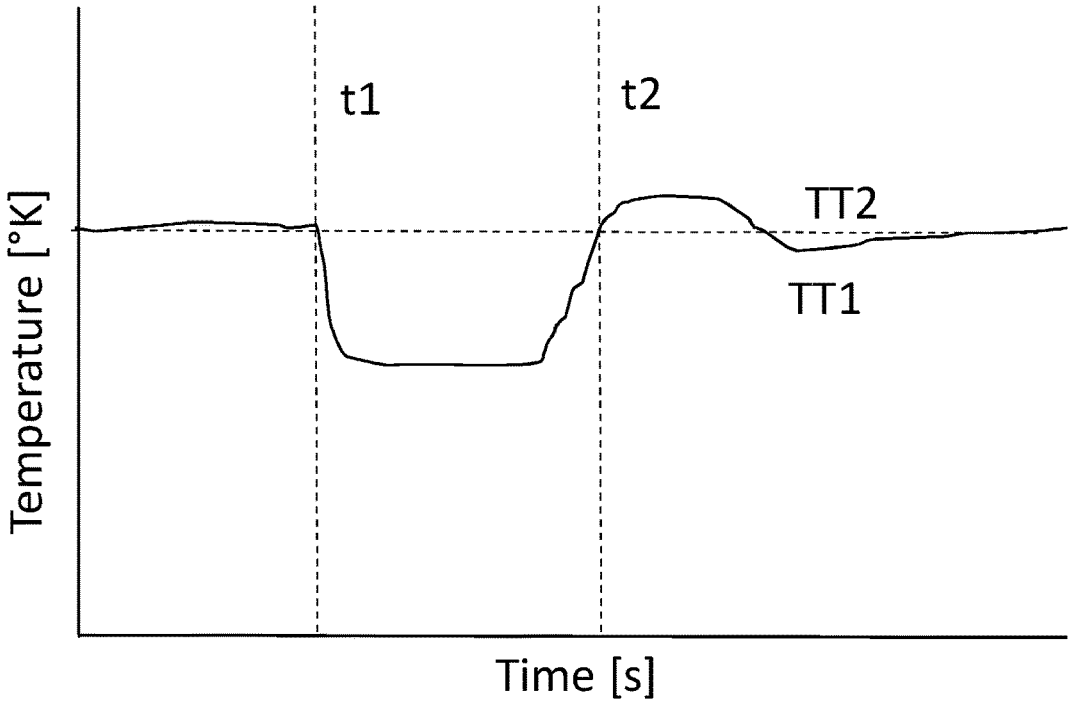

FIG. 2E shows two TT curves for a successful sealing process determined via both of the temperature sensors 9, The TT line 1 is shown as a plain line, while the TT line 2 is shown as a dotted line. As can be seen in FIG. 2E, both curves TT1 and TT2 are almost identical, therefore representing a successful sealing process. At the contrary, FIG. 2F shows two TT curves TT1 (plain) and TT2 (dotted) where the course of the curve TT1 corresponds to the one of FIG. 2A, while the course of the curve TT2 corresponds to the TT curve of FIG. 2B. In this case, the control unit 10 determines that at least for one temperature sensor 9, the determined characteristic of the TT curve does not correspond to a reference value and therefore the sealing process is considered as not successful.

The invention claimed is:

1. A method for monitoring the sealing of a container in a laboratory system or device, the system or device comprising:

a holder for receiving a container to be sealed, a heating stamp with a heating surface and a heating element for heating of the heating stamp and of the heating surface, wherein the holder and the heating stamp are movably arranged relative to each other between a loading position and a sealing position, wherein in the sealing position the heating stamp is arranged closer to the holder than in the loading position and the heating surface of the heating stamp is in contact with a foil arranged on an opening of the container, at least one temperature sensor for monitoring a temperature of the heating stamp, and a control unit connected at least to the heating element and the temperature sensor;

the method comprising the following steps:

the control unit controlling the heating element to heat the heating stamp to a predetermined sealing temperature, monitoring the temperature of the heating stamp and determining a temperature over time curve of the heating stamp by means of the at least one temperature sensor, moving the holder and/or the heating stamp from the loading position to the sealing position, after a predetermined amount of time, moving the holder and/or the heating stamp (3) from the sealing position to the loading position, the control unit determining at least one characteristic of the temperature over time curve, the control unit comparing the determined at least one characteristic of the temperature over time curve with a reference value, and the control unit determining a sealing property of the sealing of the container based on said comparison of the determined at least one characteristic of the temperature over time curve with the reference value.

2. The method according to claim 1, wherein the characteristic of the temperature over time curve is the course of the temperature over time curve and the reference value is a reference temperature over time curve.

3. The method according to claim 1, wherein the characteristic of the temperature over time curve is an integral of the temperature over time curve and the reference value is a reference integral value.

4. The method according to claim 1, wherein the system or device comprises an actuator for moving the holder and/or the heating stamp between the loading position and the sealing position and the control unit is connected to the actuator and controls the actuator for moving the holder and/or the heating stamp.

5. The method according to claim 1, wherein the at least one characteristic of the temperature over time curve is determined for a time interval, the time interval corresponding to the time where the holder and the heating stamp are in the sealing position.

6. The method according to claim 1, wherein the system or device comprises at least one force sensor for measuring a force applied to the holder and/or the heating stamp when in the sealing position and the control unit is connected to the force sensor and determines a force applied to the holder and/or the heating stamp.

7. The method according to claim 6, wherein the method further comprises the following steps:

the control unit monitoring the force applied to the holder and/or the heating stamp, the control unit determining if sufficient force has been applied to the holder and/or the heating stamp.

8. A system or device, in particular a laboratory system or device, comprising:

a holder for receiving a container to be sealed;

an heating stamp with a heating surface and a heating element for heating of the heating stamp and of the heating surface, wherein the holder and the heating stamp are movably arranged relative to each other between a loading position and a sealing position, wherein in the sealing position the heating stamp is arranged closer to the holder than in the loading position and the heating surface of the heating stamp is in contact with a foil arranged on an opening of the container;

at least one temperature sensor for monitoring a temperature of the heating stamp; and a control unit connected at least to the heating element and the temperature sensor;

wherein the control unit is configured to:

control the heating element to heat the heating stamp to a predetermined sealing temperature, monitor the temperature of the heating stamp and determine a temperature over time curve of the heating stamp by means of the at least one temperature sensor;

determine at least one characteristic of the temperature over time curve;

compare the determined at least one characteristic of the temperature over time curve with a reference value;

determine a sealing property of the sealing of the container based on said comparison of the determined at least one characteristic of the temperature over time curve with the reference value, at least between:

a movement of the holder and/or the heating stamp from the loading position to the sealing position, and a movement of the holder and/or the heating stamp from the sealing position back to the loading position after a predetermined amount of time.

9. The system or device according to claim 8, wherein the characteristic of the temperature over time curve is the course of the temperature over time curve and the reference value is a reference temperature over time curve.

10. The system or device according to claim 8, wherein the characteristic of the temperature over time curve is an integral of the temperature over time curve and the reference value is a reference integral value.

11. The system or device according to claim 8, further comprising an actuator for moving the holder and/or the heating stamp between the loading position and the sealing position and the control unit is connected to the actuator and is configured to control the actuator for moving the holder and/or the heating stamp.

12. The system or device according to claim 8, wherein the at least one characteristic of the temperature over time curve is determined for a time interval, the time interval corresponding to the time where the holder and the heating stamp are in the sealing position.

13. The system or device according to claim 8, further comprising at least one force sensor for measuring a force applied to the holder and/or the heating stamp when in the sealing position and wherein the control unit is connected to the force sensor and is configured to determine a force applied to the holder and/or the heating stamp.

14. The system or device according to claim 13, wherein the control unit is further configured to:

monitor the force applied to the holder and/or the heating stamp, and determine if sufficient force has been applied to the holder and/or the heating stamp.

15. A non-transitory computer-readable storage medium including program code, which when executed by at least one data processor, causes a system or device comprising:

a holder for receiving a container to be sealed, a heating stamp with a heating surface and a heating element for heating of the heating stamp and of the heating surface, wherein the holder and the heating stamp are movably arranged relative to each other between a loading position and a sealing position, wherein in the sealing position the heating stamp is arranged closer to the holder than in the loading position and the heating surface of the heating stamp is in contact with a foil arranged on an opening of the container, at least one temperature sensor for monitoring a temperature of the heating stamp, and a control unit connected at least to the heating element and the temperature sensor;

to perform operations comprising:

controlling the heating element to heat the heating stamp to a predetermined sealing temperature, monitoring the temperature of the heating stamp and determining a temperature over time curve of the heating stamp by means of the at least one temperature sensor;

determining at least one characteristic of the temperature over time curve;

comparing the determined at least one characteristic of the temperature over time curve with a reference value; and determining a sealing property of the sealing of the container based on said comparison of the determined at least one characteristic of the temperature over time curve with the reference value.

* * * * *